US009222675B2

(12) United States Patent
Gerendas

(10) Patent No.: US 9,222,675 B2
(45) Date of Patent: Dec. 29, 2015

(54) COMBUSTION CHAMBER HEAD WITH HOLDING MEANS FOR SEALS ON BURNERS IN GAS TURBINES

(75) Inventor: Miklos Gerendas, Am Mellensee (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 908 days.

(21) Appl. No.: 13/428,633

(22) Filed: Mar. 23, 2012

(65) Prior Publication Data

US 2012/0240595 A1 Sep. 27, 2012

(30) Foreign Application Priority Data

Mar. 24, 2011 (DE) ..... 10 2011 014 972

(51) Int. Cl.
*F23R 3/28* (2006.01)
*F23R 3/00* (2006.01)

(52) U.S. Cl.
CPC ..... *F23R 3/283* (2013.01); *F23R 3/002* (2013.01); *F23R 2900/00012* (2013.01)

(58) Field of Classification Search
CPC . F23R 3/002; F23R 3/283; F23R 2900/00012
See application file for complete search history.

(56) References Cited

U.S. PATENT DOCUMENTS 4,870,818 A * 10/1989 Suliga ..... 60/740
5,172,545 A * 12/1992 Forestier ..... 60/800
5,222,358 A * 6/1993 Chaput et al. ..... 60/796
5,419,115 A * 5/1995 Butler et al. ..... 60/804
5,463,864 A * 11/1995 Butler et al. ..... 60/796
5,577,379 A * 11/1996 Johnson ..... 60/796
5,956,955 A 9/1999 Schmid
6,679,063 B2 1/2004 Ebel
7,131,273 B2 11/2006 Howell et al.
7,140,189 B2 11/2006 Markarian et al.
7,478,534 B2 1/2009 Guezengar et al.
7,617,689 B2 * 11/2009 Schumacher et al. ..... 60/800
7,628,019 B2 12/2009 Tanner et al.
2008/0282703 A1 11/2008 Morenko et al.

FOREIGN PATENT DOCUMENTS

DE 4427222 2/1996
DE 10048864 4/2002
EP 2278226 1/2011

OTHER PUBLICATIONS

German Search Report dated Oct. 28, 2011 from counterpart application.

* cited by examiner

*Primary Examiner* — Gerald L Sung
*Assistant Examiner* — Carlos A Rivera
(74) *Attorney, Agent, or Firm* — Timothy J. Klima; Shuttleworth & Ingersoll, PLC

(57) ABSTRACT

A combustion chamber head of a gas turbine has a base plate 113 provided with a centric recess 121 in which at least one burner 106 is arranged, with the base plate 113 being connected to walls of the combustion chamber 108 and to a burner seal 116 sealing the burner 106 towards the rim of the recess 121. The burner seal 116 is arranged upstream of the base plate 113 and can be brought into contact with a collar 118 provided on the base plate 113 and forming the rim of the centric recess 121. A holding element 117 of the burner seal 116 is formed as a ring and arranged upstream of the burner seal 116 and engages with at least one projection 114 of the base plate 113 in a tension-free state.

12 Claims, 5 Drawing Sheets

COMBUSTION CHAMBER HEAD WITH HOLDING MEANS FOR SEALS ON BURNERS IN GAS TURBINES

Figure 1:
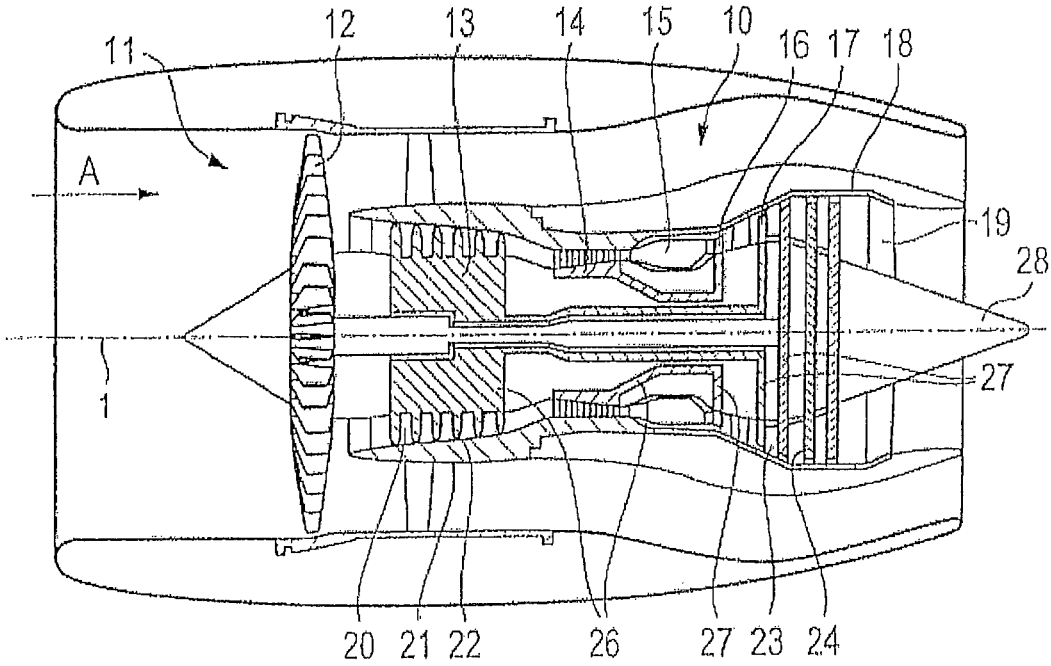

This application claims priority to German Patent Application DE 10 2011 014 972.4 filed on Mar. 24, 2011, the entirety of which is incorporated by reference herein.

This invention relates to a combustion chamber head of a gas turbine.

DE 44 27 222 A1 describes a seal around a gas-turbine burner, which is arranged downstream of a base plate of the combustion chamber, projects through a heat shield into the combustion chamber and compensates for movements between the burner fastened inside the combustion chamber casing and the combustion chamber itself, such that no inacceptable leakages result. This type of seal does not need to be gas-tight in the narrower sense.

DE 100 48 864 A1 presents a seal around a gas-turbine burner, which is arranged upstream of a base plate of the combustion chamber, projects through the base plate and a heat shield into the combustion chamber and fulfills the same function as described in the above.

As soon as the burner is inserted, the seal can no longer leave its intended place, but can only be moved in the axial direction along the burner. The actual sealing force essential for generating and maintaining the sealing function is usually provided, in the case of gas-turbine combustion chambers, not by a spring element but by the pressure difference between the outside of the combustion chamber and its inside, said pressure difference acting upon the effective surface of the seal.

Before the burner is inserted, however, and to ensure that the seal is close to the sealing surface when the gas turbine is started and is then really pressed by the resultant pressure difference against the base plate of the combustion chamber or the heat shield, a device must be provided which positions the seal close to the sealing surface without exerting pressure. With the solution known from DE 44 27 222 A1, the axial positioning is set by a spacer disc located between the base plate of the combustion chamber and the seal. The radial positioning of the seal before installation of the burner is assured by the shape of the recess in the base plate of the combustion chamber. With the solution known from DE 100 48 864 A1, the positioning of the seal in the radial and axial directions is enabled by crescent-shaped clamps held by the bolts of the heat shield.

Another approach to a solution is shown by U.S. Pat. No. 5,419,115 A and U.S. Pat. No. 5,463,864 A, where the guide and seal of the burner is fitted after the heat shield from the downstream side of the combustion chamber head, and then fastened upstream of the head by a one-part or two-part holding means joined to this burner guide. This is done in such a way that this device including guidance and holding means can perform minor sliding movements in the radial and lateral directions in order to permit insertion of the burner, and the relative movements during operation between the combustion chamber casing in which the burner is fastened and the combustion chamber can be compensated. Both publications present different embodiments of an antirotation lock for the guidance of the burner and its seal, which in some cases are designed in one piece with the combustion chamber base plate or are fastened thereto in fixed or moveable manner. U.S. Pat. No. 5,524,438 A represents in a further variation this antirotation lock as a sheet-metal ring with radial tabs which engage in recesses of adjacent annular components. These radial tabs are not used as elastic elements during assembly.

The solutions known from the state of the art result in the following disadvantages:

The spacer discs used in DE 44 27 222 A1 are adapted to the dimensions of the recess, which slows down assembly. The holding means proposed in DE 100 48 864 A1 position two seals such that when the nuts are placed on the bolts of the heat shields three components have to be held tight, which also renders assembly difficult. The assembly process provided for in U.S. Pat. No. 5,419,115 A and U.S. Pat. No. 5,463,864 A in the confined installation space of the combustion chamber head represents a hard-to-implement process step with a result which is difficult to check. Overall, all proposed solutions seem complicated, expensive and difficult due to the many components to be manufactured and fitted.

The present invention, in a broad aspect, provides a combustion chamber head of the type specified at the beginning above which, while being simply designed and easily and cost-effectively producible features a simple embodiment of the burner seal and can be assembled easily and at low cost.

It is thus provided in accordance with the invention that the combustion chamber head has a base plate provided with a centric recess in which at least one burner is arranged. The base plate is connected at its radially inner and outer areas to walls of the combustion chamber, in particular to an inner and an outer wall of an annular combustion chamber (combustion chamber casing). Furthermore, in accordance with the invention, a burner seal sealing the burner towards the rim of the recess is provided. The burner seal is, in accordance with the invention, arranged upstream of the base plate and can be brought into contact with a collar provided on the base plate and forming the rim of the centric recess. This results in sealing of the burner seal against the base plate. It is further provided in accordance with the invention that a holding element of the burner seal is designed in the form of a ring and arranged upstream of the burner seal. The annular holding element engages with at least one projection of the base plate. This projection can, for example, be designed in the form of a thickened section.

In a favorable development of the invention, the annular holding element is provided with at least one locking tab engaging with the projection (thickened section) of the base plate. The tab is preferably arranged on the inner ring of the annular holding element, but it is also possible in accordance with the invention to provide the tab on the outer ring of the annular holding element.

To engage the tab in the projection, the latter preferably has a recess into which the tab can be inserted, in particular by deformation of the tab.

To facilitate assembly of the burner, it is particularly favorable when the burner seal is designed funnel-shaped at its upstream side.

In accordance with the invention, the seal is provided upstream of the combustion chamber base plate, where the latter can be brought into contact with a base plate collar surrounding the recess for passing through the seal of the burner, where a holding mechanism of the burner seal is a simple sheet-metal ring with, for example, three outwardly projecting tabs which engage in recesses in thickened sections of the base plate of the combustion chamber. At the same time, the burner seal has at its upstream end a funnel which facilitates assembly of the burner and has no further function during operation.

Three projections of the thickened sections of the base plate act as a permanent reference during mechanical machining of the combustion chamber head. The tabs on the annular seal holding means can be fitted to the inner or outer rim of the seal holding means.

For assembly, the annular holding element (sheet-metal ring) is laid over the burner seal such that the tabs next to the recesses come to rest inside the three recesses of the thickened sections of the base plate. Then the tabs of the annular holding element are pressed down by an appropriately shaped tool in the direction of the base plate and the annular holding element is rotated by a small angular amount. As a result, the tabs engage in the recesses of the thickened section (projection) of the base plate such that the annular holding element can no longer turn back, but the tabs can snap back into their original form without remaining under tension. An antirotation lock for the burner seal itself is not necessary, based on general operational experience, and is therefore also not used by the assembly proposed here During manufacture of the combustion chamber and also later on during repair of damaged combustion chambers, the same reference points in the form of projections of thickened sections are available for mechanical machining of the combustion chamber. Between manufacture and overhaul of the combustion chamber, these projections of thickened sections perform the function of a seal holding mechanism. During assembly, the burner seal is centered by a tool. The holding mechanism of the burner seal is likewise centered and moved by the tool. Hence the fitter must grip only one tool and not three parts at the same time. This makes assembly safe and quick and means that no joining processes at all are necessary. This permits a precise, repeatable, easy and inexpensive assembly. Thanks to the tension-free state of the holding mechanism in the engaged state, there are no signs of fatigue during operation of the engine. During the entire service life of the burner seal, the latter is held close to the combustion chamber head. The sealing force is generated by the pressure difference between the air flowing around the combustion chamber and the air in the combustion chamber, and not by the holding mechanism of the burner seal. Thanks to the integrated supply funnel, this function does not require any additional component which would in turn have to be dependably fastened in a manner safe for operation. The costs for manufacture and assembly of an antirotation lock are saved, since this function is not needed.

Figure 2:
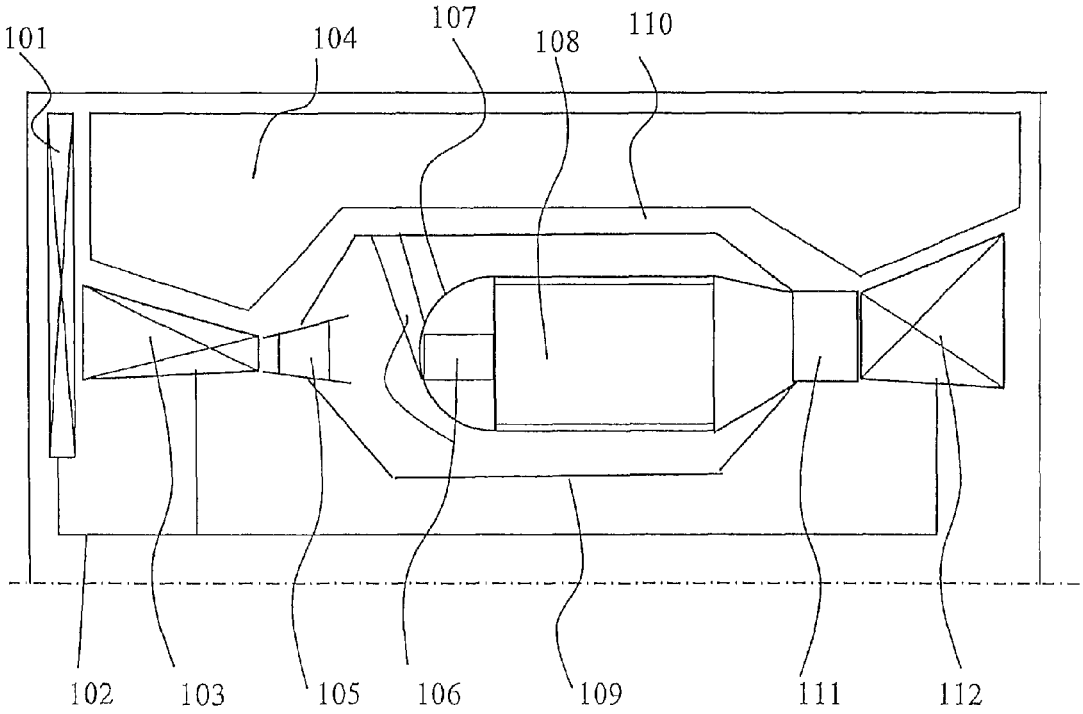
Figure 3:
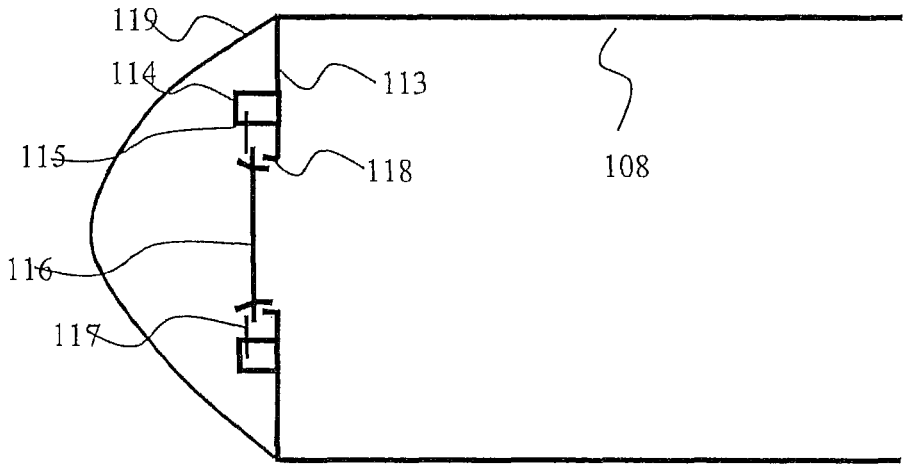
Figure 4:
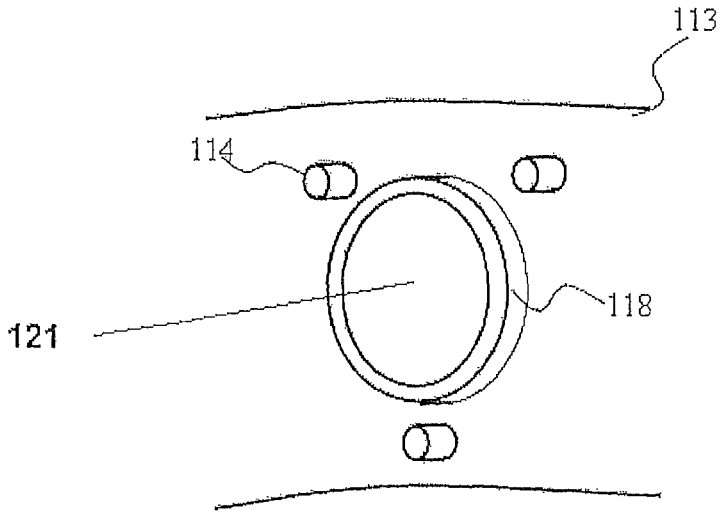
Figure 5:
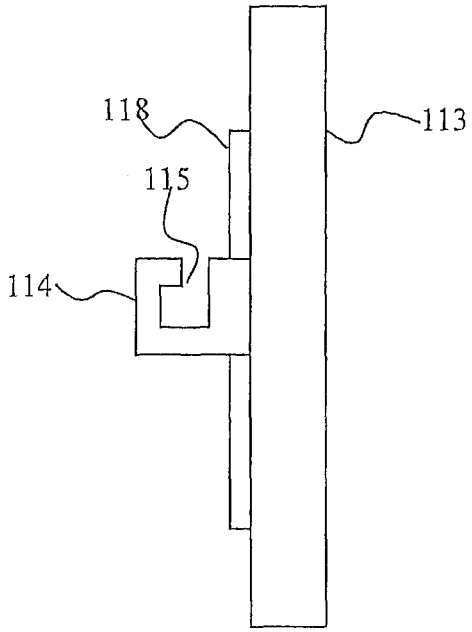
Figure 6:
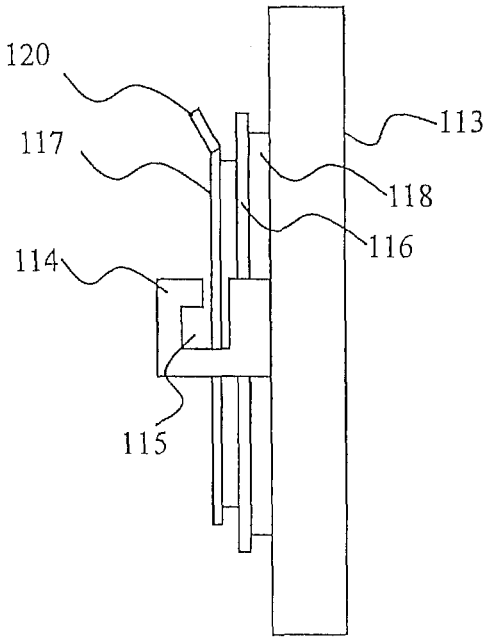
Figure 7:
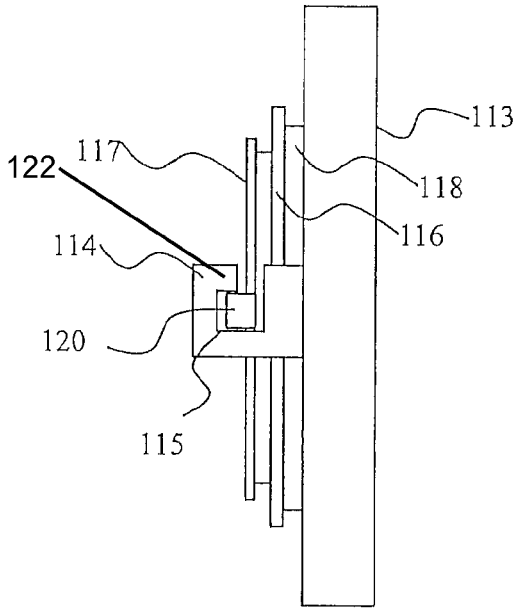
Figure 8:
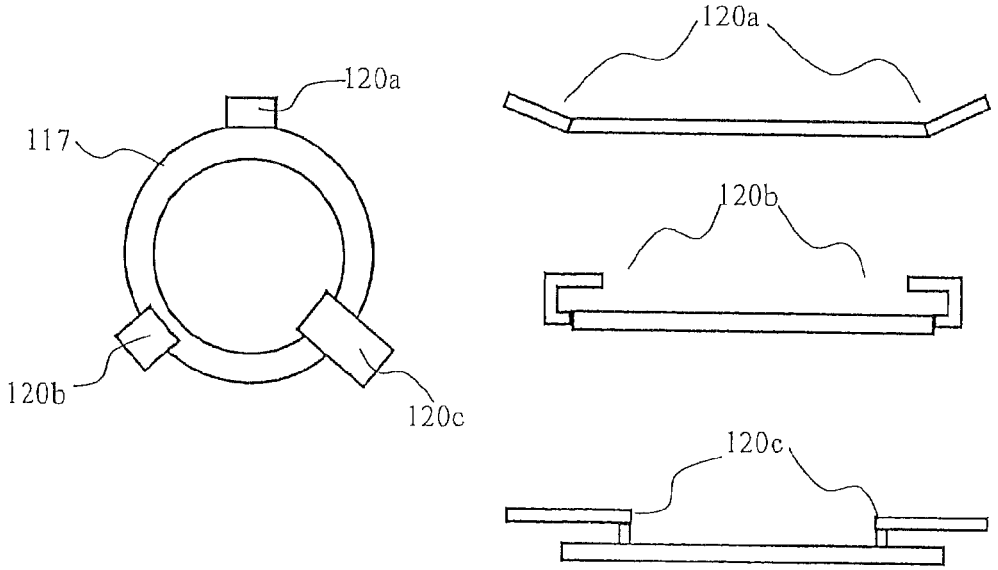

The present invention is described in the following in light of the accompanying drawing, showing preferred embodiments. In the drawing, FIG. 1 shows a schematic representation of a gas-turbine engine in accordance with the present invention, FIG. 2 shows an enlarged schematic detailed view of a combustion chamber in accordance with the present invention with appertaining gas-turbine elements, FIG. 3 shows an enlarged detailed sectional view in schematic representation of an exemplary embodiment of the inventive solution, FIG. 4 shows a perspective partial view of the base plate with collar, FIG. 5 shows a simplified partial side view of the front plate with collar and projection, FIG. 6 shows a representation by analogy with FIG. 5 of the burner seal and its holding mechanism in the assembled state, FIG. 7 shows a representation by analogy with FIGS. 5 and 6 of a further exemplary embodiment with assembled burner seal and holding mechanism, and FIG. 8 shows simplified representations of exemplary embodiments of the holding mechanism in accordance with the present invention.

The gas-turbine engine 10 in accordance with FIG. 1 is an example of a turbomachine where the invention can be used. The following however makes clear that the invention can also be used in other turbomachines. The engine 10 is of conventional design and includes in the flow direction, one behind the other, an air inlet 11, a fan 12 rotating inside a casing, an intermediate-pressure compressor 13, a high-pressure compressor 14, combustion chambers 15, a high-pressure turbine 16, an intermediate-pressure turbine 17 and a low-pressure turbine 18 plus an exhaust nozzle 19, all of which being arranged about a central engine axis 1.

The intermediate-pressure compressor 13 and the high-pressure compressor 14 each include several stages, of which each has an arrangement extending in the circumferential direction of fixed and stationary guide vanes 20, generally referred to as stator vanes and projecting radially inwards from the engine casing 21 in an annular flow duct through the compressors 13, 14. The compressors furthermore have an arrangement of compressor rotor blades 22 which project radially outwards from a rotatable drum or disc 26 linked to hubs 27 of the high-pressure turbine 16 or of the intermediate-pressure turbine 17, respectively.

The turbine sections 16, 17, 18 have similar stages, including an arrangement of fixed guide vanes 23 projecting radially inwards from the casing 21 into the annular flow duct through the turbines 16, 17, 18, and a subsequent arrangement of turbine blades 24 projecting outwards from a rotatable hub 27. The compressor drum or compressor disc 26 and the blades 22 arranged thereon, as well as the turbine rotor hub 27 and the turbine rotor blades 24 arranged thereon rotate about the engine axis 1 during operation.

FIG. 2 shows in a simplified schematic representation the area of a combustion chamber 108 of a gas turbine. This includes an inner combustion chamber casing 109 and an outer combustion chamber casing 110. Upstream of the combustion chamber 108 is arranged a combustion chamber head 107 in which several burners 106 with arm and head are arranged. The air is supplied to the combustion chamber 108 via a front blower 101 (fan) driven by a drive shaft 102. A compressor 103 is also connected to the drive shaft 102. The reference numeral 104 shows a bypass flow (bypass duct). The onflowing air is passed via a compressor outlet stator 105 with diffusor. The flow exiting the combustion chamber 108 is passed through a turbine stator 111 and a turbine rotor 112.

FIG. 3 shows in a schematic detailed view an exemplary embodiment of the inventive solution. In accordance with the invention, a base plate 113 provided with a recess which is delimited by a collar 118 is arranged at the upstream end area of the combustion chamber 108. The burners 106 pass through the recess, as shown in FIGS. 1 and 2. The base plate 113 is provided with a projection 114 (thickened section). The thickened section 114 mounts a burner seal 116 of annular design inside a recess 115, as is known from the state of the art. The burner seal 116 is held by a holding element 117 (holding ring), as described in the following figures. To facilitate assembly of the burner, the burner seal 116 is funnel-shaped at its upstream side (to the left in FIG. 3).

FIG. 4 shows a part of the circularly designed base plate 113 provided with the collar 118 which delimits the recess 121 for passing through one of the burner 106. Three projections 114 (thickened sections of the base plate 113) are distributed around the circumference of the collar 118.

FIG. 5 shows a schematized partial sectional side view of the base plate 113 with the collar 118 and a projection 114 with a recess 115. FIG. 6 shows the arrangement shown in FIG. 5 in the assembled state of the annular burner seal 116 as well as the holding element 117 (holding ring). The holding element 117 includes a locking tab (tab) 120, as will be described below. FIG. 6 shows here the arrangement of the locking tab 120 on the radially outer area of the holding element 117, as shown in the right-hand half of FIG. 8. Three locking tabs (tabs) 120 are shown here distributed around the circumference.

FIG. 7 shows a variant in which the locking tab 120 is inserted into the recess 115 of the projection 114. Recess retainer 122 provides a positive stop for the locking tab 120. The locking tab is depressed/bent toward the base plate 113 to clear the recess retainer 122 as the holding element 117 is rotated into locking position until the tab 120 clears the recess retainer 122 and returns to its normal non-depressed state, positioned further away from the base plate 113 within the recess 115. In this way, the tab 120 has sprung back to be at a level height with the recess retainer 122 such that the recess retainer 122 prevents back rotation of the holding element 117 unless the tab 120 is again depressed. In an alternative embodiment, the tab 120 can have a flat normal position and is bent into the retention position aside the recess retainer 122 after being rotated into the recess 115. Hence the completely assembled state is shown.

The left-hand half of FIG. 8 shows the annular/ring form of the holding element 117. The right-hand half of FIG. 8 shows variants of the locking tabs, i.e. a locking tab 120*a* of the seal holding element 117. The variant of the locking tab 120*b* is arranged on the outside of the holding element 117, while the variant of the locking tab 120*c* is arranged on the inside of the holding element 117. The locking tabs 120*b* and 120*c* are each shown in the bent state.

LIST OF REFERENCE NUMERALS

1 Engine axis
10 Gas-turbine engine
11 Air inlet
12 Fan rotating inside the casing
13 Intermediate-pressure compressor
14 High-pressure compressor
15 Combustion chambers
16 High-pressure turbine
17 Intermediate-pressure turbine
18 Low-pressure turbine
19 Exhaust nozzle
20 Guide vanes
21 Engine casing
22 Compressor rotor blades
23 Guide vanes
24 Turbine blades
26 Compressor drum or disc
27 Turbine rotor hub
28 Exhaust cone
101 Front blower (fan)
102 Drive shaft
103 Compressor
104 Bypass flow
105 Compressor outlet stator with diffusor
106 Burner with arm and head
107 Combustion chamber head
108 Combustion chamber
109 Inner combustion chamber casing
110 Outer combustion chamber casing
111 Turbine stator
112 Turbine rotor
113 Base plate of combustion chamber 108
114 Thickened section of base plate 113/projection
115 Recess of thickened section 114
116 Burner seal
117 Holding mechanism of burner seal/holding element/holding ring
118 Collar of base plate 113 for supporting the burner seal 116
119 Cover of base plate 113
120*a* Locking tab of seal holding element 117
120*b* Bent variant of locking tab on the outside of the seal holding element 117
120*c* Bent variant of locking tab on the inside of the seal holding element 117
121 Recess
122 Recess retainer

What is claimed is:

1. A combustion chamber head of a gas turbine comprising:
a base plate having:
a centric recess for positioning at least one burner;
at least one projection;
a collar forming a rim of the centric recess;
the base plate being connectable to walls of the combustion chamber and to a burner seal sealing the at least one burner towards the rim of the centric recess;
the burner seal being arranged upstream of the base plate to engage the collar; and
a holding element arranged upstream of the burner seal for holding the burner seal, the holding element having an annular form and engaging the at least one projection in a tension-free state;
wherein the holding element includes at least one locking tab engaging with the at least one projection in the tension-free state;
wherein the at least one projection includes at least one recess into which the at least one locking tab is inserted;
wherein the at least one locking tab is spring biased for positioning in the at least one recess and is in the tension-free state when positioned in the at least one recess.

2. The combustion chamber head of claim 1, wherein the at least one tab is attached to an inner rim of the holding element.

3. The combustion chamber head of claim 1, wherein the the at least one tab is attached to an outer rim of the holding element.

4. The combustion chamber head of claim 3, wherein the at least one projection includes at least one recess retainer positioned adjacent the at least one recess which extends closer toward the base plate than a portion of the at least one locking tab when the at least one locking tab is positioned in the at least one recess in the tension-free state to prevent rotation of the at least one locking tab out of the at least one recess.

5. The combustion chamber head of claim 4, wherein the burner seal is funnel-shaped at an upstream side to facilitate introduction of the burner.

6. The combustion chamber head of claim 1, wherein the at least one projection includes at least one recess retainer positioned adjacent the at least one recess which extends closer toward the base plate than a portion of the at least one locking tab when the at least one locking tab is positioned in the at least one recess in the tension-free state to prevent rotation of the at least one locking tab out of the at least one recess.

7. The combustion chamber head of claim 2, wherein the burner seal is funnel-shaped at an upstream side to facilitate introduction of the burner.

8. A combustion chamber head of a gas turbine comprising:
a base plate having:
a centric recess for positioning at least one burner;
at least one projection;
a collar forming a rim of the centric recess;
the base plate being connectable to walls of the combustion chamber and to a burner seal sealing the at least one burner towards the rim of the centric recess;

the burner seal being arranged upstream of the base plate to engage the collar; and a holding element arranged upstream of the burner seal for holding the burner seal, the holding element having an annular form and engaging the at least one projection in a tension-free state;

wherein the holding element includes at least one locking tab engaging with the projection in the tension-free state;

wherein the at least one projection includes at least one recess into which the at least one locking tab is inserted;

wherein the at least one projection includes at least one recess retainer positioned adjacent the at least one recess which extends closer toward the base plate than a portion of the at least one locking tab when the at least one locking tab is positioned in the at least one recess in the tension-free state to prevent rotation of the at least one locking tab out of the at least one recess.

9. The combustion chamber head of claim 8, wherein the at least one tab is attached to an inner rim of the holding element.

10. The combustion chamber head of claim 9, wherein the burner seal is funnel-shaped at an upstream side to facilitate introduction of the burner.

11. The combustion chamber head of claim 8, wherein the at least one tab is attached to an outer rim of the holding element.

12. The combustion chamber head of claim 11, wherein the burner seal is funnel-shaped at an upstream side to facilitate introduction of the burner.

* * * * *